United States Patent [19]

Rowe et al.

[11] 4,256,415

[45] Mar. 17, 1981

[54] CONCRETE VIBRATOR MACHINE

[75] Inventors: Murray A. Rowe, Canton; Robert T. Conway, Rapid City, both of S. Dak.; Herbert C. Glesmann, Omaha; Richard W. Kruse, Fort Calhoun, both of Nebr.

[73] Assignee: CMI Corporation, Oklahoma City, Okla.

[21] Appl. No.: 86,416

[22] Filed: Oct. 19, 1979

[51] Int. Cl.[3] ..... E01C 19/38

[52] U.S. Cl. ..... 404/116; 172/140

[58] Field of Search ..... 404/116, 115, 72, 113; 172/140

[56] References Cited

U.S. PATENT DOCUMENTS

| | | | |
|---|---|---|---|
| 2,148,214 | 2/1939 | Mall | 404/116 |
| 2,248,107 | 7/1941 | Mall | 404/116 |
| 2,261,659 | 11/1941 | Pierce | 404/116 |
| 2,744,456 | 5/1956 | Mittelstadt | 404/116 |
| 3,753,621 | 8/1973 | Dale | 404/116 |
| 4,128,359 | 12/1978 | Cooper | 404/116 X |

*Primary Examiner*—Nile C. Byers, Jr.

*Attorney, Agent, or Firm*—Emrich, Root, Lee, Brown & Hill

[57] ABSTRACT

A concrete vibrator machine wherein the vibrators thereof are mounted on individual supporting structures that are adjustable longitudinally of the main frame of the machine, and wherein the vibrators are raised and lowered on their individual supporting structures in such a manner that if the vibrators strike an obstruction during lowering thereof, lowering of the vibrators may stop without damaging stress being placed thereon.

16 Claims, 9 Drawing Figures

CONCRETE VIBRATOR MACHINE

BACKGROUND OF THE INVENTION

This invention relates to concrete vibrator machines, and, more particularly, to concrete vibrator machines which are particularly well adapted for use on bridge decks, and the like.

A primay object of the present invention is to afford a novel concrete vibrator machine.

Another object is to provide a novel concrete vibrator machine which is particularly well adapted for use on bridge decks, and the like, wherein reinforcing bars, or the like, are embedded in the concrete.

Concrete vibrator machines of the general type to which this invention pertains have been heretofore known in the art, being shown, for example, in U.S. Pat. No. 4,128,359, issued Dec. 5, 1978 to Charles R. Cooper, Jr., et al. It is an important object of the present invention to afford a novel concrete vibrator machine which is an improvement over concrete vibrator machines heretofore known in the art.

Concrete vibrator machines heretofore known in the art have commonly had several inherent disadvantages, such as, for example, not having vibrators that are movable laterally of the longitudinal surface on which the concrete is disposed; not embodying vibrators that are readily adjustable on the machine; not embodying vibrators that are readily adjustable relative to each other; being complicated in construction and operation; or not being reliable in operation, and the like. It is an important object of the present invention to overcome such disadvantages.

Another object of the present invention is to afford a novel concrete vibrator machine which embodies a plurality of vibrators, and wherein the vibrators may be adjusted relative to each other in a novel and expeditious manner.

Yet another object of the present invention is to afford a novel concrete vibrator machine of the aforementioned type, wherein the vibrators are mounted on the machine in a novel and expeditious manner.

An object ancillary to the foregoing is to afford a novel concrete vibrator machine of the aforementioned type, wherein the vibrators are mounted on individual supporting structures in a novel and expeditious manner.

A further object of the present invention is to afford a novel concrete vibrator machine of the aforementioned type, which embodies novel supporting structures for the vibrators.

Another object of the present invention is to afford a novel concrete vibrator machine wherein the vibrators are raised and lowered in a novel and expeditious manner.

A further object of the present invention is to afford a novel concrete vibrator machine of the aforementioned type, which may be used in conjunction with a concrete finishing machine, and wherein the movement of the vibrator machine along the concrete surface to be vibrated may be automatically controlled in a novel and expeditious manner.

Another object of the present invention is to afford a novel concrete vibrator machine which is practical and efficient in operation and which may be readily and economically produced commercially.

Other and further objects of the present invention will be apparent from the following description and claims and are illustrated in the accompanying drawings which, by way of illustration, show a preferred embodiment of the present invention and the principles thereof and what we now consider to be the best of mode in which we have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

Figure 1:
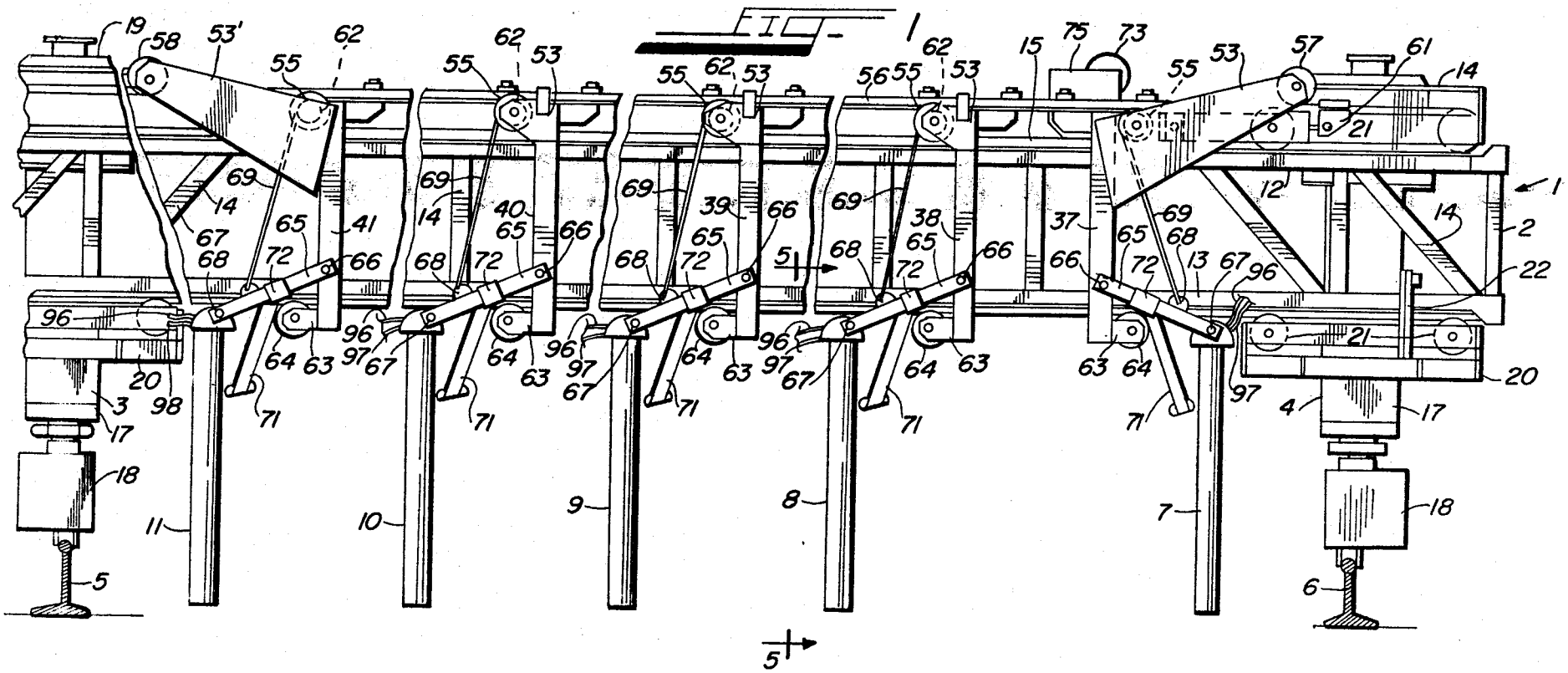
FIG. 1 is a fragmentary front elevational view of a vibrator machine embodying the principles of the present invention.

A concrete vibrator machine 1, embodying the principles of the present invention, is shown in the drawings to illustrate the presently preferred embodiment of the present invention.

The vibrator machine 1 embodies, in general, an elongated body or supporting frame 2 having carriages 3 and 4 disposed at opposite ends thereof for transporting the machine 1 longitudinally along a longitudinally extending body of concrete to be vibrated, such as, for example, along concrete on a bridge deck, or the like, the carriages 3 and 4 being movable along suitable supports, such as rails 5 and 6, FIG. 1, disposed at opposite sides of the bridge deck, or the like, not shown, to be paved. The machine 1 is particularly well adapted for vibrating concrete being laid on bridge decks, and the like, although, as will be appreciated by those skilled in the art, it may be used for other concrete-laying operations without departing from the purview of the broader aspects of the present invention.

The vibrator machine 1 also embodies a plurality of hydraulically actuated vibrators 7, 8, 9, 10 and 11 mounted on the frame 2. The vibrators 7–11 may be of any suitable type, well known in the art, and are movable upwardly and downwardly relative to the frame 2 for raising and lowering the vibrators 7–11 relative to the concrete to be vibrated, and the vibrators 7–11 are also movable longitudinally of the frame 2 for movement laterally of the concrete to be vibrated, as will be discussed in greater detail presently.

The frame 2 embodies an elongated top rail 12 and an elongated lower rail 13 connected together in parallel spaced relation to each other by suitable cross members 14, FIG. 1. Two pipes or rods 15 and 16 are disposed on the upper face of the top rail 12 and the lower face of the bottom rail 13, respectively, and are secured thereto by suitable means such as, for example, welding.

Each of the carriages 3 and 4 are identical in construction, except that they are mirror images of each other. Each embodies an upper portion 17, which is adjustably mounted on a lower portion 18, for vertical adjustment relative thereto to thereby raise and lower the frame 2. The lower portion 18 of the carriages 3 and 4 are in the form of bogies, adapted to being moved along the rails 5 and 6, respectively.

The upper portion 17 of each of the carriages 3 and 4 embodies an upper trolley 19 and a lower trolley 20 disposed above and below the frame 2, respectively, FIG. 1. Each trolley 19 and 20 embodies two wheels 21, the wheels 21 of the trolleys 19 resting on the pipe 15 for movement therealong, and the wheels 21 of the trolleys 20 being disposed in underlying abutting engagement with the pipe 16 for movement therealong, and to act as holddown rollers. A bracket 22 is mounted on the trolley 20 of the carriage 4 in position to clampingly engage the lower rail 13 of the frame 2 to thereby hold the carriage 4 against movement relative to the frame 2. The other carriage 3 is not so restrained relative to the frame 2 so that, as the machine 1 moves along the rails 5 and 6, the carriage 3 may move inwardly and outwardly on the frame 2 if the spacing between the rails 5 and 6 narrows and widens, respectively.

Figure 3:
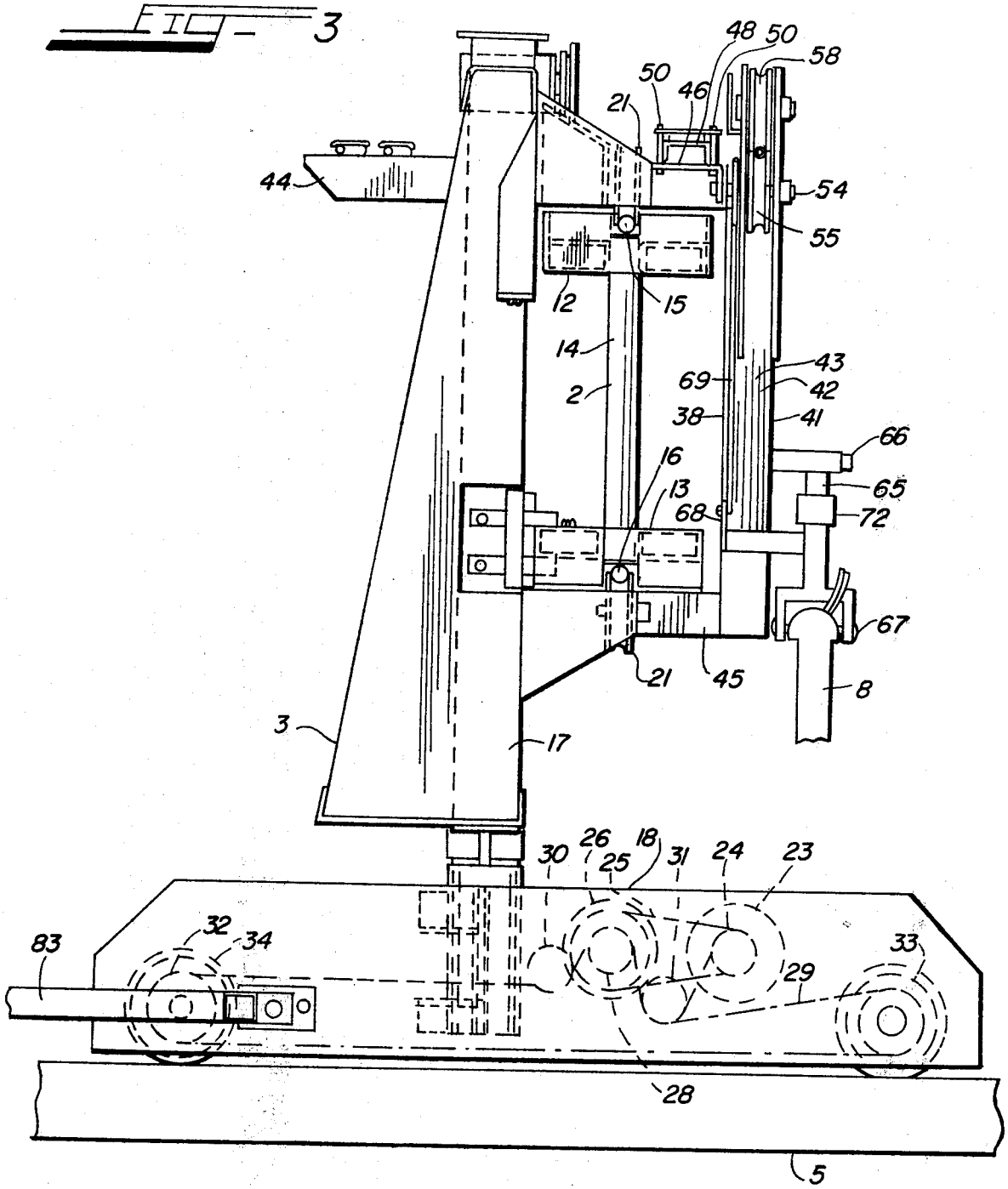
FIG. 3 is an end elevational view of the machine shown in FIG. 1.
Figures 4, 5:
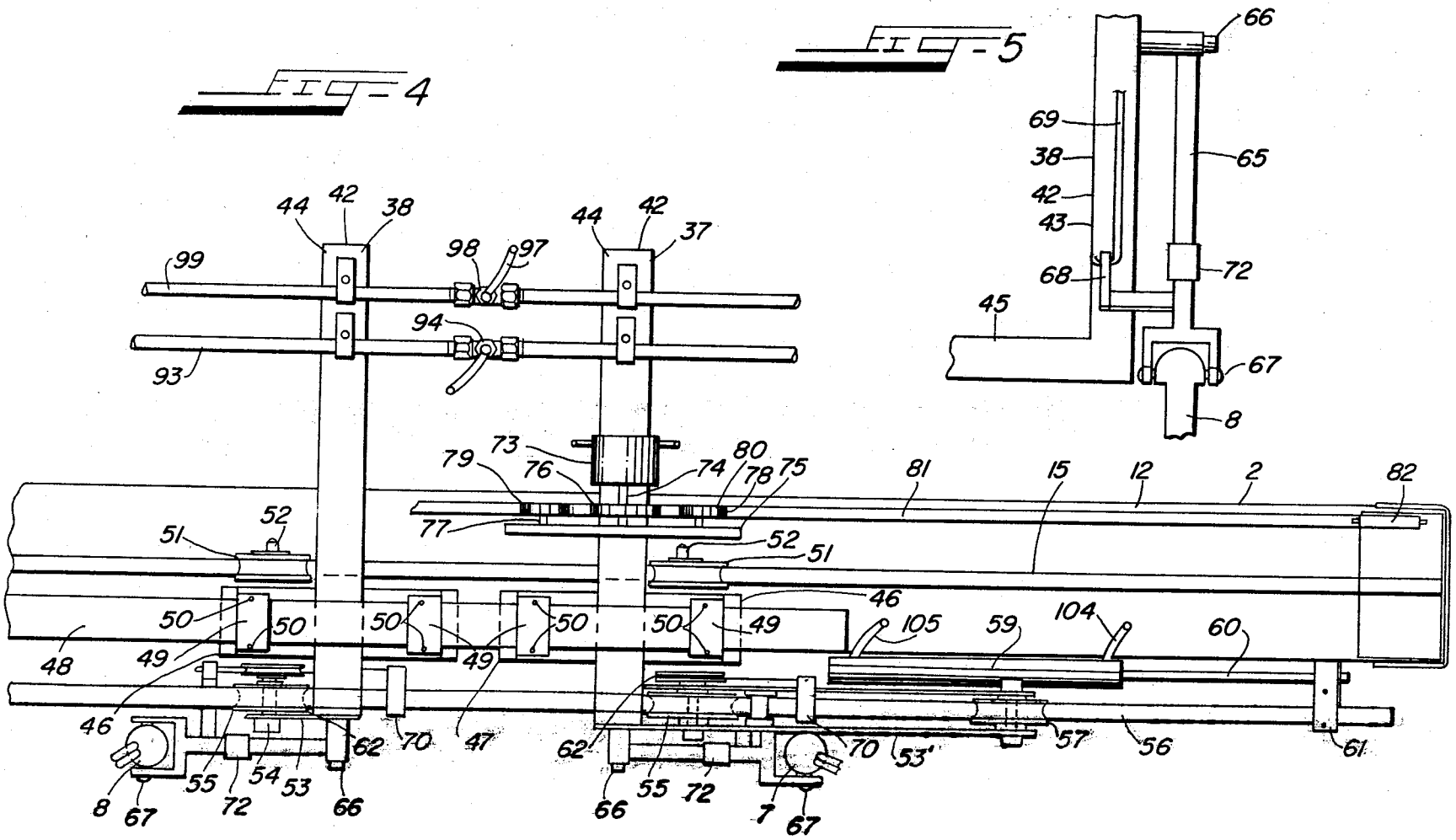
FIG. 4 is a fragmentary top plan view of the machine shown in FIG. 1, with certain parts broken away.
FIG. 5 is a fragmentary, detail, elevational view taken substantially along the line 5—5 in FIG. 1.
Figure 6:
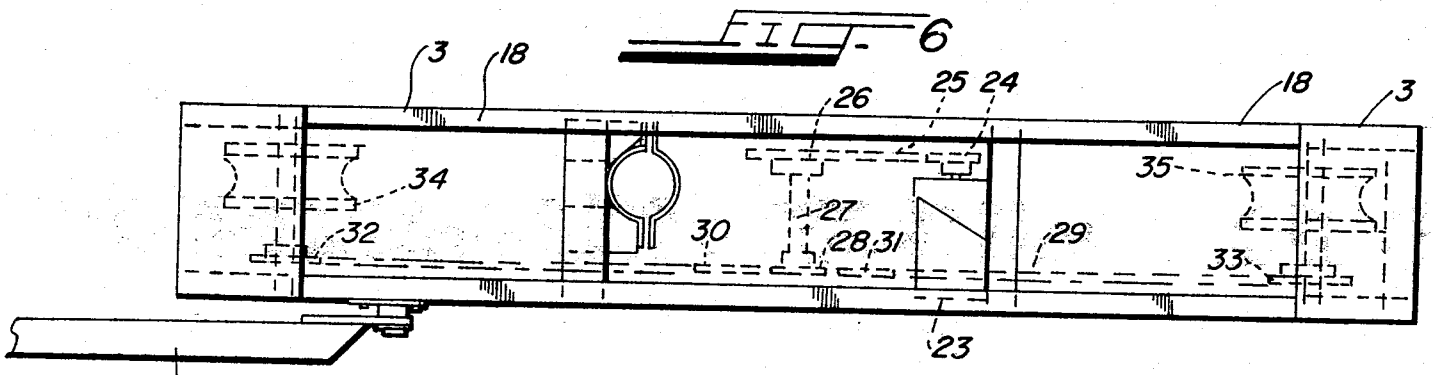
FIG. 6 is a top plan view of the bogie shown in FIG. 3.
Figure 7:
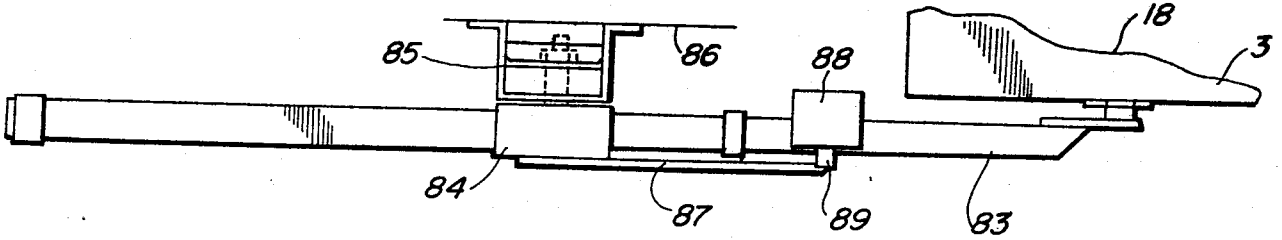
FIG. 7 is a somewhat diagrammatic top plan view, similar to FIG. 6, showing the control mechanism for the drive mechanism of the bogie shown in FIG. 6.
Figure 8:
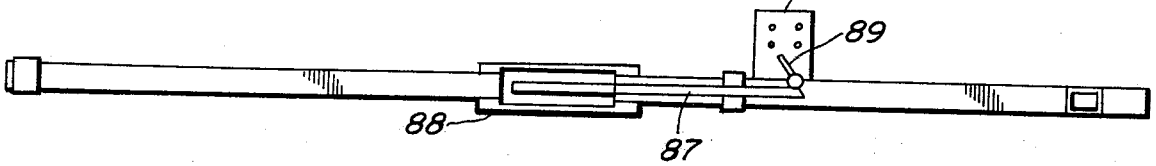
FIG. 8 is a side elevational view of the control mechanism shown in FIG. 7.

As shown in FIGS. 3 and 5 with respect to the bogie 18 of the carriage 3, each of the bogies 18 embodies a hydraulic motor 23 having a sprocket wheel 24 thereon. Actuation of the motor 23 is effective, through rotation of the sprocket wheel 24, to drive a chain 25, which is trained around a sprocket wheel 26 secured to a shaft 27. Rotation of the shaft 27 is effective to rotate a sprocket wheel 28 mounted thereon. A chain 29 extends from the sprocket wheel 28 around idler sprocket wheels 30 and 31 to sprocket wheels 32 and 33, which are operatively connected to drive wheels 34 and 35, respectively, in each of the bogies 18. Thus, rotation of the sprocket wheels 24 in one direction is effective to move the machine forwardly along the rails 5 and 6, and rotation of the sprocket wheel 24 in the other direction is effective to move the machine 1 rearwardly along the rails 5 and 6. Operation of the motor 23 may be controlled in a suitable manner, as will be discussed in greater detail presently.

Each of the vibrators 7–11 is mounted on an individual supporting structure 37, 38, 39, 40 and 41, respectively, in a manner which will be discussed in greater detail presently. The supporting structures 37–41 are identical in construction, except that the supporting structure 37 is a mirror image of the other supporting structures 38–41.

Each of the supporting structures 37–41 includes a C-frame 42, FIG. 3, having a substantially upright front member 43, an upper leg 44 projecting rearwardly from the upper end of the member 43 across the top of the top rail 12 of the frame 2, and a lower leg 44 projecting rearwardly from the lower end of the member 43 below the bottom rail 13 of the supporting frame 2. The members 43–45 may be made of any suitable material, such as, for example, wrought iron, and, preferably, are of inverted U-shape in transverse cross section.

Each of the upper legs 44 of each of the supporting structures 37–41 has two elongated, substantially inverted U-shaped members 46 and 47 projecting laterally outwardly from opposite sides thereof in longitudinal alignment with each other, forwardly of the pipe 15 on the frame 2, FIGS. 3 and 4. All of the members 46 and 47 are disposed in longitudinal alignment with each other, and an elongated, substantially inverted U-shaped member 48 rests on and extends across the upper face thereof. The elongated member 48 is secured to the members 46 and 47 by suitable means such as metal clamps 49 secured against the upper surface thereof by bolts 50 that are threaded into the underlying members 46 and 47, FIGS. 3 and 4. Thus, each of the supporting structures 37–41 is secured to the member 48, but is releasably secured thereto for adjustment therealong, longitudinally of the machine 1 and relative to each other.

Each of the supporting structures 37–41 also embodies a roller 51 rotatably mounted on a shaft 52, which projects rearwardly from the member 46 thereof, the rollers 51 being disposed in position to rest on top of the pipe 15 on the frame 2 for movement therealong.

Each of the supporting structures 38–40 also includes a supporting plate 53 secured to the upper end portion of the front member 43 thereof and extending therefrom in forwardly spaced, parallel relation to the adjacent member 46, FIGS. 1 and 4. Similarly, the supporting structures 37 and 41 include a supporting plate 53', which is disposed in forwardly spaced, parallel relation to the member 46 thereon, but the supporting plate 53' is longer than the supporting plate 53, for a purpose which will be discussed in greater detail presently. Each of the supporting structures 37–41 also includes a shaft extending between, and mounted in the members 46 and the respective mounting plates 53 and 53', and a roller 55 journaled on the respective shaft 54, FIG. 4. The rollers 55 are disposed in radial alignment with each other.

The vibrator machine 1 also embodies an elongated member in the form of a rod or pipe 56 disposed above the frame 2 in forwardly disposed, parallel relation thereto, FIGS. 1 and 4. The pipe 56 extends longitudinally of the machine 1 and rests on top of the rollers 55 on the supporting structures 37–41. Two other rollers 57 and 58 are journaled on the mounting plates 53' of the supporting structures 37 and 41, respectively, in laterally outwardly disposed relation to the rollers 55 thereon, FIGS. 1 and 4. The rollers 57 and 58 are disposed in radial alignment with each other and with the rollers 55, and are disposed in position to rest on the pipe 56 to act as hold-down rollers for the pipe 56.

A hydraulic cylinder 59, FIGS. 1 and 4, is secured to the end portion of the member 48 that projects laterally outwardly from the C-frame 42 of the supporting structure 37, FIGS. 1 and 4, and the piston 60 thereof is operatively connected to the pipe 56 by a clamp 61. Actuation of the hydraulic cylinder 59 is effective to move the pipe 56 longitudinally between the rollers 55 and the rollers 57 and 58, for a purpose which will be discussed in greater detail presently.

Each of the supporting structures 37–41 also includes a sheave 62 mounted on the respective shaft 54 thereof between the member 46 and the forwardly disposed roller 55, FIGS. 1 and 4. The sheaves 62 form a part of the mechanism for raising and lowering the vibrators 7–11, as will be discussed in greater detail hereinafter.

Each of the supporting structures 37–41 also includes a mounting plate 63 projecting laterally from the rear end of the lower leg 45 of the C-frame 42 thereof, FIG. 1. Rollers 64 are rotatably mounted on the free end portions of respective ones of the mounting plate 63 in radial alignment with each other and in position to operatively engage the pipe 16 on the lower rail 13 of the frame 2 for movement therealong, the rollers 64 acting as hold-down rollers for retaining the rollers 51 in engagement with the upper pipe 15 of the frame 2.

Each of the vibrators 7–11 is pivotally connected to the front member 43 of the C-frame 42 of the supporting structures 37–41, respectively, by a respective elongated member 65, one end of which is connected to the front of the C-frame 42 of the respective supporting structure 37–41 by a suitable means such as a pin or bolt 66, FIGS. 1 and 5, and the other end of which is pivotally connected to the upper end portion of the respective vibrators 7–11 by a suitable pin or bolt 67. Each of the members 65 has a substantially L-shaped member 68 projecting rearwardly therefrom, FIG. 5. A plurality of cables 69 have their lower end portions connected to the upper end portions of respective ones of the L-shaped members 68, and each of the cables 69 extends upwardly from the respective L-shaped member 68 and is trained over a respective one of the sheaves 62 of the supporting structures 37–41, respectively, FIG. 1. The other end portions of the cables 69 are secured to the pipe 56 by suitable means such as clamps 70, FIG. 4. Thus, it will be seen that movement of the pipe 56 to the right, as viewed in FIG. 1, along the rollers 55 is effective to pivot the members 65 upwardly around the pivot pin 66 and thereby raise the vibrators 7–11; and movement of the pipe 56 to the left, as viewed in FIG. 1, is effective to permit the vibrators 7–11, by gravity, to rotate the arms 65 downwardly around the pivot pin 66 to thereby lower the vibrators 7–11.

Figure 2:
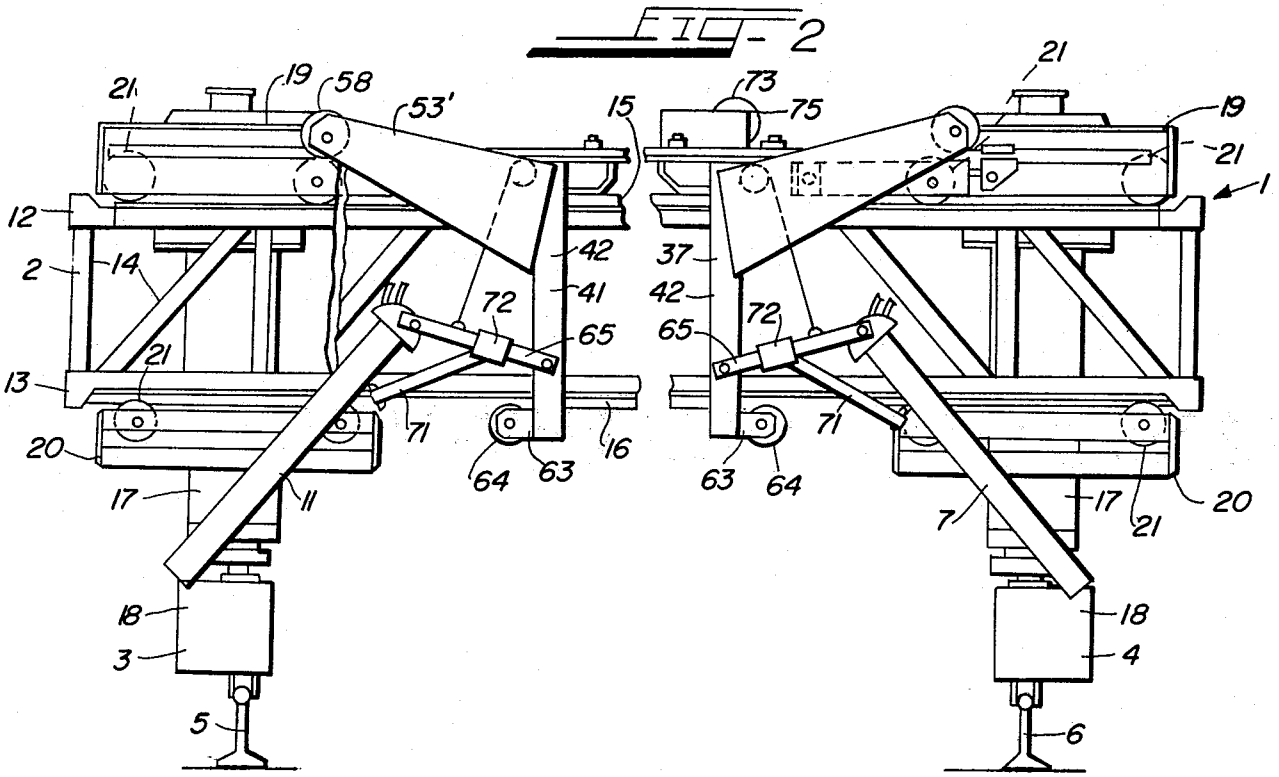
FIG. 2 is a view similar to FIG. 1, but showing certain parts disposed in different operative positions.

Each of the members 65 has an elongated abutment member 71 secured thereto by a collar 72 midway between the pins 66 and 67, FIG. 1. The abutment members 71 project from the respective members 65 at a downwardly opening acute angle in such position that, when the arms 65 are rotated upwardly around the pins 66 to move the vibrators 7–11 from lowered position, as shown in FIG. 1, to raised position, as shown in FIG. 2, the abutment members 71 are effective to abuttingly engage the lower longitudinal surface of the respective vibrators 7–11 and pivot them upwardly around the respective pins 67 into an acute angle to the horizontal, thus increasing the distance that the vibrators 7–11 are moved upwardly away from the bridge deck, or the like, as compared to the distance that they would be raised if they were permitted to hang free on the respective members 65.

The machine 1 also embodies a suitable drive mechanism, such as, for example, a hydraulic motor 73, FIG. 4, for moving the vibrators 7–11 back and forth longitudinally of the machine 1. The hydraulic motor 73 is mounted on the upper leg 44 of the C-frame 42 of the supporting structure 37, and has a drive shaft 74 projecting forwardly therefrom. A supporting plate 75 is mounted on the supporting structure 37 in upright position relative thereto forwardly of the motor 73, FIG. 4, and the drive shaft projects through, and is journaled in the supporting plate 75. A sprocket wheel 76 is mounted on the drive shaft 74, for rotation therewith, between the motor 73 and the supporting plate 75. Two shafts 77 and 78 project rearwardly from the mounting plate 75 on opposite sides of the drive shaft 74, and two sprocket wheels 79 and 80 are journaled on the shafts 77 and 78, respectively, in radial alignment with the sprocket wheel 76, FIG. 4.

A sprocket chain 81 in disposed on top of and extends the length of the frame 2 of the machine 1. It is connected to the top rail 12 of the frame 2 at each end of the sprocket chain 81 by suitable means such as clips 82, one of which is shown in FIG. 4. The sprocket chain 81 is so disposed on the machine 1 that it passes under the sprockets 79 and 80, in operative engagement therewith, and over the sprocket 76, in operative engagement therewith. Thus, it will be seen that operation of the motor 73 in a manner to effect clockwise rotation of the sprocket wheel 76, as viewed in FIG. 1, is effective to move the supporting structure 37 to the right, as viewed in FIG. 1; and operation of the motor 73 in such a manner as to drive the sprocket wheel 73 in a counter-clockwise direction, as viewed in FIG. 1, is effective to move the supporting structure 37 to the left, as viewed in FIG. 1.

It will be remembered that the supporting structures 37–41 are all connected together by the elongated member 48, to which they are clamped, so that movement of the supporting structure 37 longitudinally of the machine 1, along the pipes 15 and 16 is effective to correspondingly move the supporting structures 38–41. Such movement, of course, is effective to correspondingly move the vibrators 7–11. Thus, it will be seen that by operation of the hydraulic motor 73, the position of the vibrators 7–11, laterally of a bridge deck, or the like, may be readily effected.

In the preferred form of the vibrator machine 1, controls are afforded on one of the bogies 18 of the carriages 3 and 4, such as, for example, the bogie 18 of the carriage 3 for automatically actuating the drive mechanism in both of the bogies 18 for maintaining a predetermined range of spacing between the machine 1 and the concrete finishing machine, or the like, following the same. The purpose of this control mechanism is to enable the vibrator machine 1 to move a predetermined distance ahead of the following concrete finishing machine, stop and perform the desired vibrating of the concrete, and, then, when the concrete finishing machine moves forwardly to within a predetermined distance of the vibrator machine 1, to again be moved forwardly to the predetermined distance ahead of the concrete finishing machine, stop and again commence the vibrating cycle of operation.

To this end, in the preferred form of the vibrator machine 1, a control rod 83 is attached to and extends rearwardly from the bogie 18 of the carriage 3, FIGS. 3 and 6–8. A sleeve 84 is slidably mounted on the control rod 83 and has a mounting bracket 85 pivotably secured thereto by suitable means such as a pin 85'. When the vibrator machine 1 is to be thus controlled, the mounting bracket 85 may be secured to the side of the vibrator machine 86, indicated diagrammatically in FIG. 7, by suitable means, such as, for example, welding. An actuating rod 87 is secured to the collar 84 and projects forwardly therefrom in outwardly spaced, parallel relation to the control rod 83, FIGS. 7 and 8. A solenoid valve 88 is mounted on and carried by the control rod 83, and embodies an actuator 89, which is disposed in position to be engaged, and actuated by the actuating rod 87 when the concrete finishing machine moves to the aforementioned position adjacent to the vibrator machine 1 from which the vibrator machine 1 is again advanced relative to the concrete finishing machine. This advancement is effected in a manner which will be discussed in greater detail presently.

From the foregoing it will be seen that the vibrator machine 1 embodies a hydraulic cylinder 59 for raising and lowering the vibrators 7–11; a hydraulic motor 73 for moving the vibrators 7–11 laterally of a bridge deck, or the like; and hydraulic motors 23 in each of the bogies 18 for moving the machine 1, and, therefore, the vibrators 7–11 longitudinally of a bridge deck, or the like. Hydraulic fluid for actuating these units is supplied thereto by a suitable pump 90 from a suitable reservoir 91, FIG. 9. The pump 90 and the reservoir 91 may be mounted on and form a part of the vibrator machine 1, in a suitable position, now shown, but, preferably, are afforded by a reservoir and pump on the concrete finishing machine, with which the machine 1 is to be used.

Figure 9:
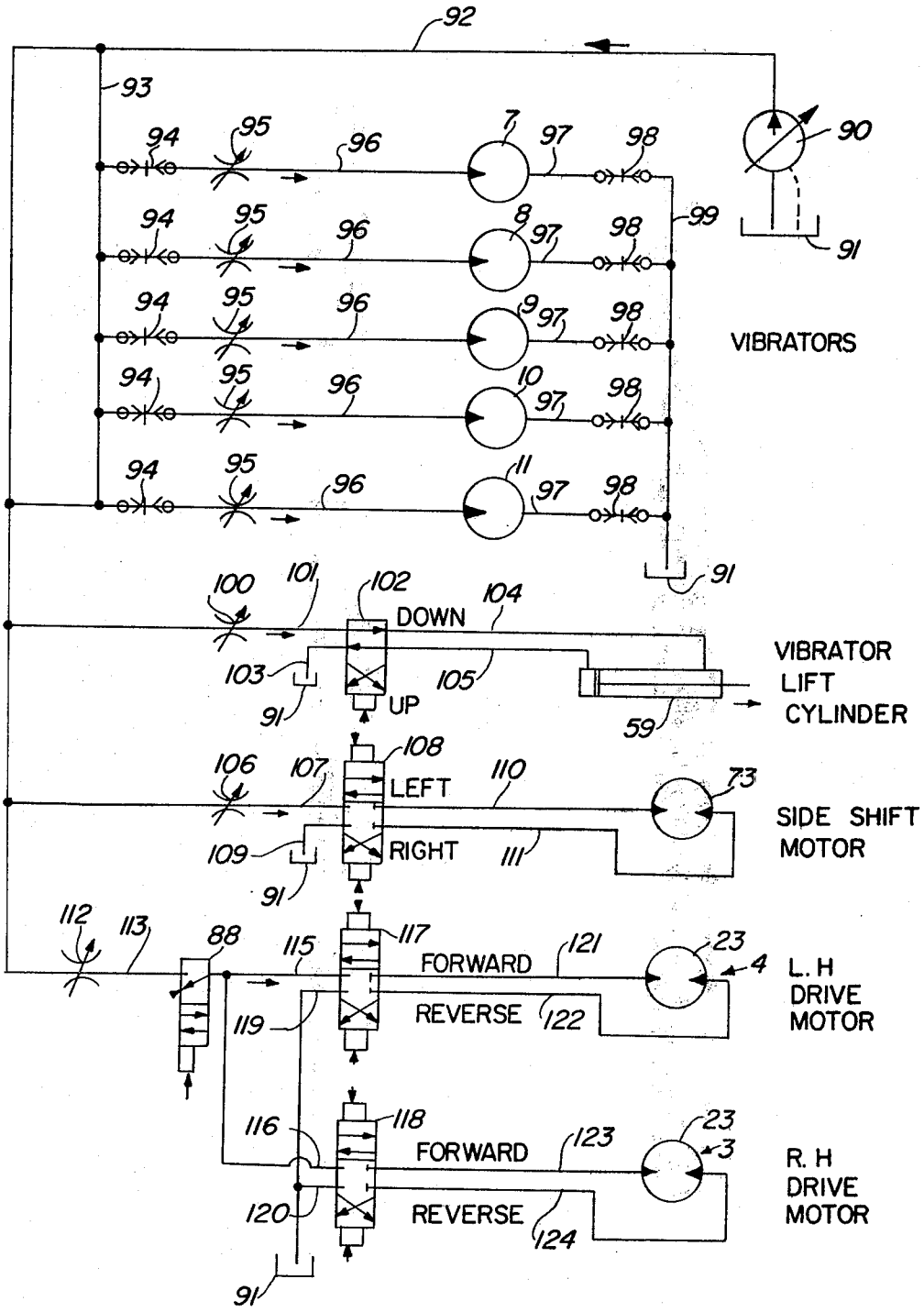
FIG. 9 is a hydraulic diagram showing the controls for the machine shown in FIG. 1.

In the operation of the vibrator machine 1, when the pump 90 is actuated, hydraulic fluid is fed from the reservoir 91 into a main supply line 92, FIG. 9, from which it flows into, among other places, a supply pipe 93 mounted on top of and movable with the supporting structures 37–41, FIG. 4. The supply line 93 is connected through suitable connectors 94 and flow control valves 95 to the inlet conduits 96 of the respective vibrators 7–11, FIG. 9. The outlet conduits 97 of the vibrators 7–11 are connected through suitable connectors 98 and a return line 99 to sump 91. Preferably, the vibrators 7–11 are caused to vibrate by the flow of hydraulic fluid therethrough at all times during the operation of the machine 1.

The main supply line 92 is also connected through a control valve 100 and a conduit 101 to the inlet side of a solenoid valve 102. The outlet side of the solenoid valve 102 is connected by a conduit 103 back to sump 91. The solenoid valve 102 is connected by two conduits 104 and 105 to opposite ends of the hydraulic cylinder 59. When the solenoid valve 102 is disposed in position to feed fluid through the conduit 105 to the head end of the cylinder 59, and feed fluid from the other end of the cylinder 59 through the conduit 104 to sump 91, the cylinder 59 is actuated to effect raising of the vibrators 7–11. When the solenoid valve 102 is actuated to feed fluid through the conduit 104 to the aforementioned other end of the cylinder 59 and feed fluid from the head end of the cylinder 59 through the conduit 105 to sump 91, the cylinder 59 is actuated to lower the vibrators 7–11.

The main supply line 92 is also connected through a flow control valve 106 and a conduit 107 to the inlet side of a solenoid valve 108. The outlet side of the solenoid valve 108 is connected through a conduit 109 to sump 91. When the solenoid valve 108 is disposed in position to connect the line 107 to the conduit 110, connected to one side of the motor 73, and to connect the line 109 to the conduit 111, connected to the other side of the motor 73, the flow of fluid through the motor 73 is effective to drive the motor 73 in such a manner as to rotate the sprocket 76 in a counter-clockwise direction, as viewed in FIG. 1, and thereby move the vibrators 7–11 to the left, as viewed in FIG. 1. On the other hand, when the solenoid valve 108 is disposed in position wherein it is effective to connect the line 107 to the conduit 111 and to connect the line 109 to the conduit 110, the motor 73 is driven in such a manner as to be effective to rotate the sprocket wheel 76 in a clockwise direction, as viewed in FIG. 1, and thereby move the vibrators 7–11 to the right, as viewed in FIG. 1. Disposition of the solenoid valve 108 in a position intermediate the last two mentioned positions is effective to stop flow of hydraulic fluid to the motor 73 and, therefore, stop operation of the same.

In addition, the supply line 92 is connected through a flow control valve 112 and a conduit 113 to the inlet side of the solenoid valve 88. The outlet side of the solenoid valve 88 is connected by conduits 115 and 116 to the inlet sides of solenoid valves 117 and 118, respectively. The outlet sides of the solenoid valves 117 and 118 are connected by conduits 119 and 120, respectively, to sump 91. Conduits 121 and 122 extend between the drive motor 23 of the carriage 4 and the solenoid 117, and conduits 123 and 124 extend between the drive motor 23 of the carriage 3 and the solenoid 118. When the solenoid valves 117 and 118 are disposed in position to feed fluid from the conduits 115 and 116 into the conduits 121 and 123, respectively, and feed fluid from the conduits 122 and 124 into the conduits 119 and 120, they are disposed in position to cause the motors 23 in the carriages 4 and 3, respectively, to move the machine forwardly. On the other hand, when the solenoid valves 117 and 118 are disposed in position to feed fluid from the conduits 115 and 116 into the conduits 122 and 124, respectively, and to feed fluid from the conduits 121 and 123 into the conduits 119 and 120, respectively, they are disposed in position to cause the motors 23 to drive the machine 1 rearwardly. When the solenoid valves 117 and 118 are disposed in the position intermediate the last two mentioned positions thereof, they are effective to prevent flow of fluid to the motors 23 and, therefore, prevent or stop operation thereof.

It will be remembered that the solenoid valve 88 forms part of the control mechanism for controlling the automatic advancement of the machine 1 relative to the concrete finishing machine with which it is being used. Preferably, it is a slow-to-release solenoid valve 88, the release time of which determines the amount that the machine 1 moves forwardly ahead of the following concrete finishing machine during each such forward movement of the machine 1. When the solenoid valve 88 is disposed in position to cut off flow between the line 113 and the inlet conduits 115 and 116, it is effective to stop the operation of the motors 23 and thereby prevent forward movement of the machine 1. On the other hand, when the solenoid valve 88 is disposed in position to permit flow of fluid from the line 113 into the conduits 115 and 116, it is then effective to permit the aforementioned forward movement of the machine 1, when the solenoid valves 117 and 118 are disposed in the aforementioned position wherein the conduit 115 is connected to the conduits 121 and 123, and the conduits 122 and 123 are connected to the conduits 119 and 120. Normally, when the solenoid valve 88 is being used to control movement of the machine 1, solenoid valves 117 and 118 will be disposed in position to effect forward movement thereof. Preferably, when reverse movement of the machine 1 is desired, this will be effected through a manual control valve, not shown, which bypasses the solenoid valve 88.

As will be appreciated by those skilled in the art, if it is desired to have the vibrators 7–11 disposed closer to the concrete finishing machine than they are when the vibrators 7–11 are disposed on the side of the machine 1 remote from the finishing machine, this may be readily accomplished by merely reversing the position of the machine 1 on the rails 5 and 6, and running the machine 1 in the "reverse" direction, without departing from the purview of the broader aspects of the present invention. For such operation, the control rod 83 would project from the carriage 3 in the direction opposite to that shown in drawings, and, during automatic operation of the machine 1, the solenoid valves 117 and 118 would be in the "reverse" position illustrated in FIG. 9.

The controls, not shown, for the pump 90 and the solenoid valves 102, 108, 117 and 118 may be located at any convenient location, such as, for example, on the rear end portion of the machine 1, but, preferably, they are located at the control station for the concrete finishing machine used in conjunction with the vibrator machine 1.

From the foregoing it will be seen that, by loosening the straps 49 from their clamping engagement with the member 48, the supporting structures 37–41 are freed for adjustment into any desired position longitudinally of the frame 2, to thereby correspondingly adjust the vibrators 7–11. After such adjustment of the vibrators 7–11, the bolts 50 may again be tightened to dispose the straps 49 in clamping engagement with the member 48 and thus secure the vibrators 7–11 in the desired adjusted position relative to each other. For example, if it were desired to vibrate concrete at one foot intervals across a span of twenty-one feet, the vibrators 7–11 may be spaced four feet from each other with the vibrators 7 and 11 being so disposed that, when the vibrators 7 and 11 are at their ends of travel laterally across the span to be vibrated, the vibrator 7 or 11, which is disposed closest to an edge of the span, is disposed one foot in from that edge. With this arrangement, the concrete can be vibrated at one foot intervals by moving all of the vibrators simultaneously three times for a distance of one foot, the vibrators 7–11 being raised prior to each such lateral movement and again lowered for vibrating the concrete. As will be appreciated by those skilled in the art, the vibrators 7–11 may be adjusted to other spacings and be moved greater or lesser distances between successive vibrations.

After the concrete has thus been vibrated entirely across the lateral surface thereof, the machine 1 may be advanced the desired distance, such as, for example, the aforementioned one foot, and the spaced vibration operation of the machine 1 may then be repeated in the opposite direction laterally across the concrete, the motor 73 being effective to move the vibrators 7–11 back and forth across the bridge deck, or the like, being vibrated, as previously described.

From the foregoing, it will be seen that the present invention affords a novel concrete vibrator machine wherein a plurality of vibrators, which are movable simultaneously laterally across a bridge deck, or the like, can be quickly and easily positioned relative to each other in a novel and expeditious manner.

In addition, it will be seen that the present invention affords a novel vibrator machine of the aforementioned type wherein the vibrators are carried by novel individual supports.

Also, it will be seen that the present invention affords a novel vibrator machine of the aforementioned type wherein the vibrators are raised and lowered from the concrete being vibrated, in a novel and expeditious manner.

Also it will be seen that the present invention affords a novel vibrator machine of the aforementioned type wherein intermittent movements of the machine longitudinally of the bridge deck, on which it is being used, may be controlled and effected in a novel and expeditious manner.

In addition, it will be seen that the present invention affords a novel vibrator machine of the aforementioned type, which is practical and efficient in operation and which may be readily and economically produced commercially.

Thus, while we have illustrated and described the preferred embodiment of our invention, it is to be understood that this is capable of variation and modification and we therefore do not wish to be limited to the precise details set forth, but desire to avail ourselves of such changes and alterations as fall within the purview of the following claims.

We claim:

1. A concrete vibrator machine for vibrating concrete disposed on a longitudinally extending area, said machine comprising
   a. an elongated supporting frame adapted to extend laterally across such an area,
   b. supporting means mounted on the opposite ends of said supporting frame for transporting said supporting frame longitudinally of such an area,
   c. a plurality of other supporting means mounted on said supporting frame for movement longitudinally of the latter,
   d. vibrator means mounted on respective ones of said other supporting means,
   e. means for moving said vibrator means downwardly and upwardly relative to said respective ones of said other supporting means into and out of such concrete, and
   f. means for moving said other supporting means longitudinally of said supporting frame.

2. A concrete vibrator machine as defined in claim 1, and in which
   a. said other supporting means includes rollers rotatable along said supporting frame.

3. A concrete vibrator machine as defined in claim 1, and in which
   a. each of said respective ones of said other supporting means comprises an auxiliary supporting frame extending transversely across said first mentioned supporting frame.

4. A concrete vibrator machine as defined in claim 3, and which includes
   a. means operatively connecting said auxiliary supporting frames together for movement, as a unit, longitudinally of said first mentioned supporting frame.

5. A concrete vibrator machine as defined in claim 4, and in which
   a. each of said auxiliary supporting frames includes
      (1) a roller disposed on top of said first mentioned supporting frame for rotation longitudinally of the latter, and
      (2) means extending below said first mentioned supporting frame in position to hold said roller down against the latter.

6. A concrete vibrator machine as defined in claim 5, and in which
   a. said last mentioned means includes another roller operatively engaged with said first mentioned supporting frame.

7. A concrete vibrator machine as defined in claim 4, and in which
   a. said means for moving said other supporting means comprises (1) elongated means mounted on and extending longitudinally of said first mentioned supporting frame, (2) a drive wheel operatively engaged with said elongated means, and (3) a drive motor mounted on said means operatively connecting said auxiliary supporting frames together and operatively connected to said drive wheel for rotating the latter and thereby move said drive wheel longitudinally along said elongated means.

8. A concrete vibrator machine as defined in claim 4, and a. which includes (1) a plurality of elongated lever arms, and b. in which (1) each of said elongated lever arms has one end portion pivotally mounted on a respective one of said auxiliary supporting frames, and (2) each of said vibrator means is mounted on the other end portion of a respective one of said lever arms.

9. A concrete vibrator machine as defined in claim 8, and in which a. said means for moving said vibrator means comprises a hydraulic cylinder operatively connected to said lever arms for swinging the latter upwardly and downwardly on said auxiliary supporting frames.

10. A concrete vibrator machine as defined in claim 8, and in which a. said means for moving said vibrator means comprises (1) a plurality of sheaves rotatably mounted on respective ones of said auxiliary supporting frames, (2) an elongated member extending across said auxiliary supporting frames, (3) a plurality of elongated cables trained over respective ones of said sheaves and each having one end connected to said elongated member and another end connected to said lever arm on said respective one of said auxiliary supporting frames, and (4) means for longitudinally reciprocating said elongated member relative to said sheaves.

11. A concrete vibrator machine as defined in claim 10, and in which a. said means for longitudinally reciprocating said elongated member comprises hydraulic cylinder means.

12. A concrete vibrator machine as defined in claim 1, and in which a. each of said respective ones of said other supporting means comprises a C-frame having (1) an elongated, substantially upright member, (2) one leg extending from the top end portion of said upright member transversely across the top of said first mentioned supporting frame, and (3) another leg extending from the bottom end portion of said upright member transversely across the bottom of said first mentioned supporting frame.

13. A concrete vibrator machine as defined in claim 12, and a. which includes (1) a plurality of elongated lever arms, and b. in which (1) each of said elongated lever arms has one end portion pivotally mounted on the side of said upright member remote from said first mentioned supporting frame, and (2) each of said vibrator means is mounted on the other end portion of a respective one of said lever arms.

14. A concrete vibrator machine as defined in claim 13, and in which a. said means for moving said vibrator means comprises (1) a plurality of sheaves rotatably mounted on respective ones of said C-frames, (2) an elongated member extending across said C-frames, (3) a plurality of elongated cables trained over respective ones of said sheaves and each having one end connected to said elongated member and another end connected to said lever arm on said respective one of said C-frames, and (4) means for longitudinally reciprocating said elongated member relative to said sheaves to thereby (a) pull said lever arms and vibrators up during movement of said elongated member in one direction, and (b) permit said lever arms and vibrators to move down during movement of said elongated member in the opposite direction.

15. A concrete vibrator machine as defined in claim 14 and a. which includes (1) other elongated members mounted on respective ones of said lever arms in downwardly depending position to abuttingly engage said vibrator mounted on the respective lever arm and positively move said last mentioned vibrator up during said lifting of said respective lever arm.

16. A concrete vibrator machine as defined in claim 1, and a. in which said first mentioned supporting means at each end of said supporting frame includes wheels, and b. which includes (1) drive means of said wheels, (2) control means for said drive means, including (a) an elongated member projecting from said first mentioned supporting means, (b) a solenoid valve mounted on said elongated member, and (c) an actuating member slidably mounted on said elongated member for movement into and out of actuating position relative to said solenoid valve.

* * * * *

UNITED STATES PATENT AND TRADEMARK OFFICE

CERTIFICATE OF CORRECTION

PATENT NO. : 4,256,415

DATED : Mar. 17, 1981

INVENTOR(S) : Murray A. Rowe et al

It is certified that error appears in the above—identified patent and that said Letters Patent is hereby corrected as shown below:

Col. 3, line 42: change "wheels" to --wheel--, and

Col. 12, line 52: change "of" to --for--.

Signed and Sealed this

*Thirtieth* Day of *June 1981*

[SEAL]

*Attest:*

RENE D. TEGTMEYER

*Attesting Officer*

*Acting Commissioner of Patents and Trademarks*